US006422525B1

(12) United States Patent
McAdam et al.

(10) Patent No.: US 6,422,525 B1
(45) **Date of Patent: *Jul. 23, 2002**

(54) PUMPKIN STAND

(75) Inventors: John J. McAdam, Reading; Emerson M. Reyner, II, Palmyra, both of PA (US)

(73) Assignee: Sheerlund Products, Inc., Gilbertsville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/645,300

(22) Filed: Aug. 24, 2000

Related U.S. Application Data

(63) Continuation-in-part of application No. 09/258,223, filed on Feb. 26, 1999.

(51) Int. Cl.[7] ..... A47B 91/00; B45D 19/00; B21Q 1/00

(52) U.S. Cl. ..... 248/346.01; 248/346.11; 248/146; 248/519; 269/54.5; 269/295

(58) Field of Search ..... 248/346.01, 684, 248/346.03, 346.5, 694, 910, 146, 519, 346.11; 269/54.5, 53; 206/493, 525; 220/574.1; 99/419

(56) References Cited

U.S. PATENT DOCUMENTS 348,671 A 9/1886 Haehnlen
1,344,915 A * 6/1920 Love ..... 99/42 V
1,471,122 A 10/1923 Greaves
1,630,188 A * 5/1927 Knauff ..... 99/419
2,102,542 A 12/1937 Markle, Jr.
2,206,694 A 7/1940 Greene
2,257,970 A 10/1941 Long
2,584,295 A * 2/1952 Sanzenbacher ..... 269/54.5
2,751,951 A * 6/1956 Strathaus ..... 269/54.5
2,781,651 A 2/1957 Cutler
2,924,330 A 2/1960 Ballard
2,928,537 A 3/1960 Stagner
2,932,119 A 4/1960 Borah
2,953,180 A * 9/1960 Kyles ..... 269/54.5
3,030,994 A * 4/1962 Wysowski ..... 269/54.5
3,183,545 A 5/1965 Bergstrom
3,451,328 A 6/1969 Swett
3,912,249 A 10/1975 Vaca ..... 269/54.5
3,995,844 A * 12/1976 Hellman ..... 269/54.5
4,140,340 A * 2/1979 Cloutier ..... 269/295
4,558,197 A * 12/1985 Wyatt ..... 219/732
4,576,140 A 3/1986 Schlosser ..... 126/25 R
4,759,524 A 7/1988 Anderson ..... 248/346.1
4,896,011 A * 1/1990 Trucks ..... 219/725
5,221,069 A 6/1993 Struthers et al. ..... 248/231.9
5,353,926 A 10/1994 Yeh ..... 206/217
5,685,217 A * 11/1997 Kreitzer ..... 99/419
6,145,795 A * 11/2000 McAdam et al. ..... 248/146

* cited by examiner

*Primary Examiner*—Anita King
(74) *Attorney, Agent, or Firm*—Howson and Howson

(57) ABSTRACT

A stand having pedestals for providing a support for a pumpkin being carved and/or displayed. The stand also protects an underlying surface from juices and debris discharged from the pumpkin.

10 Claims, 4 Drawing Sheets

PUMPKIN STAND

RELATED APPLICATIONS

This application is a continuation-in-part of co-pending U.S. application Ser. No. 09/258,223 filed Feb. 26, 1999.

FIELD OF THE INVENTION

The present invention relates to stands for supporting and displaying objects, more particularly, the present invention relates to a stand for the support and display of a carved or uncarved pumpkin.

BACKGROUND OF THE INVENTION

Heretofore, a carved pumpkin or jack-o-lantern has generally been placed for display on a surface such as an outdoor porch or patio or an indoor windowsill. Carving often takes place on an indoor table. Fluids that leak from a carved or uncarved pumpkin can often stain such underlying surfaces, and pumpkin juice stains are difficult to remove.

Several devices for supporting items of produce have been disclosed in the patented prior art. For instance, U.S. Pat. No. 2,257,970 issued to Long discloses a support structure that includes a reservoir intended to protect a person from the juice of a watermelon while it is being eaten in an automobile.

U.S. Pat. No. 2,928,537 issued to Stagner discloses a support for an apple for packaging and handling. This support provides a pedestal with spikes for securing the apple upright inside a cube-like box.

While the patented devices may function satisfactorily for their intended purposes, there is a need for a device that securely holds a pumpkin above a shallow reservoir while being carved, and that protects underlying surfaces from the pumpkin's juices, during and after carving (or if left uncarved). There is also a need for a device that stabilizes and displays a carved or uncarved pumpkin both inside and outside the home.

OBJECTS OF THE PRESENT INVENTION

With the foregoing in mind, a primary object of the present invention is to provide a novel device for displaying a carved or uncarved pumpkin either inside or outside the home.

A second object of the present invention is to provide a stable base for supporting a pumpkin during carving.

A third object of the present invention is to provide a stable base for supporting a carved or uncarved pumpkin during display.

A fourth object of the present invention is to provide a pumpkin support that affords complete ventilation of the pumpkin while on display.

A fifth object of the present invention is to provide protection for the surface beneath a carved or uncarved pumpkin (such as a floor, rug or table) from fluids discharged from the pumpkin during carving or display.

A sixth object of the present invention is to provide a device for elevating the pumpkin to promote air circulation in order to retard decay, and to keep the pumpkin bottom away from any discharged juices that might accelerate disintegration.

SUMMARY OF THE INVENTION

The present invention provides a stand for use in carving and displaying a pumpkin. The stand comprises a plurality of pedestals projecting upwardly and integrally from a topside of a base. Each pedestal has a chamfered surface and at least one pin projecting upwardly for the purpose of engaging and positioning a pumpkin so as to preclude any movement relative to the base, and for the purpose of elevating the pumpkin above the base and an underlying surface. The base is seated on the bottom of a dish which has an upturned flange at its perimeter to form a receptacle for containing fluids discharged from the pumpkin during carving and afterward. Preferably, the base and dish are separate components, and the base is annular having a central opening.

BRIEF DESCRIPTION OF THE DRAWINGS

The foregoing and other objects, features and advantages of the present invention should become apparent from the following description when taken in conjunction accompanying drawing in which.

DESCRIPTION OF THE PREFERRED EMBODIMENTS

Figure 3:
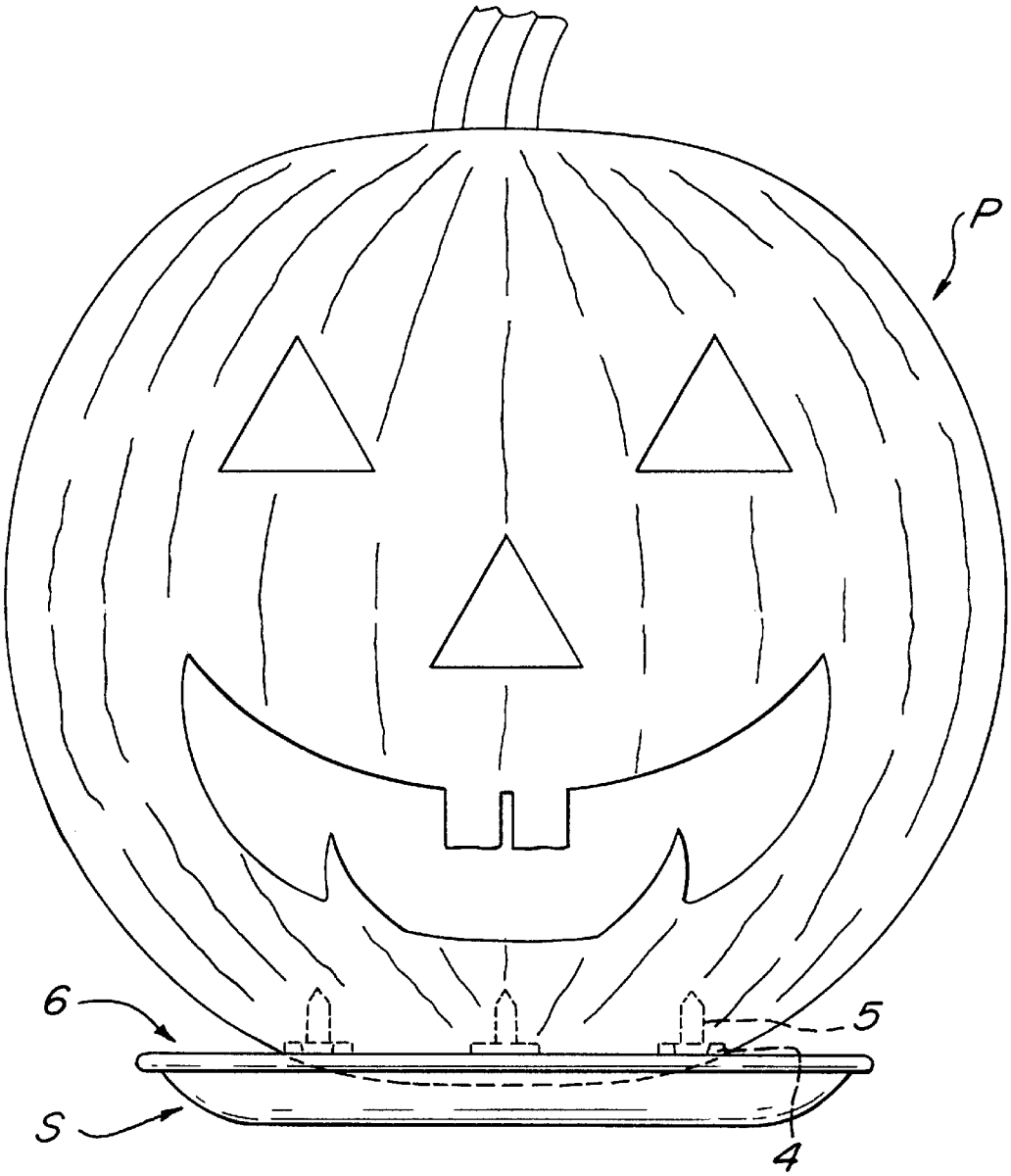
FIG. 3 is an elevational view of the stand of FIG. 1 while performing its intended function of displaying a carved pumpkin.

As best seen in FIG. 3, the present invention provides a stand S intended for display, support and preservation of a pumpkin P as well as for protection of underlying surfaces from any liquids discharged from the pumpkin during carving and subsequent display. In addition the stand S collects any rain or condensate that collects on the outside of the pumpkin.

Figure 1:
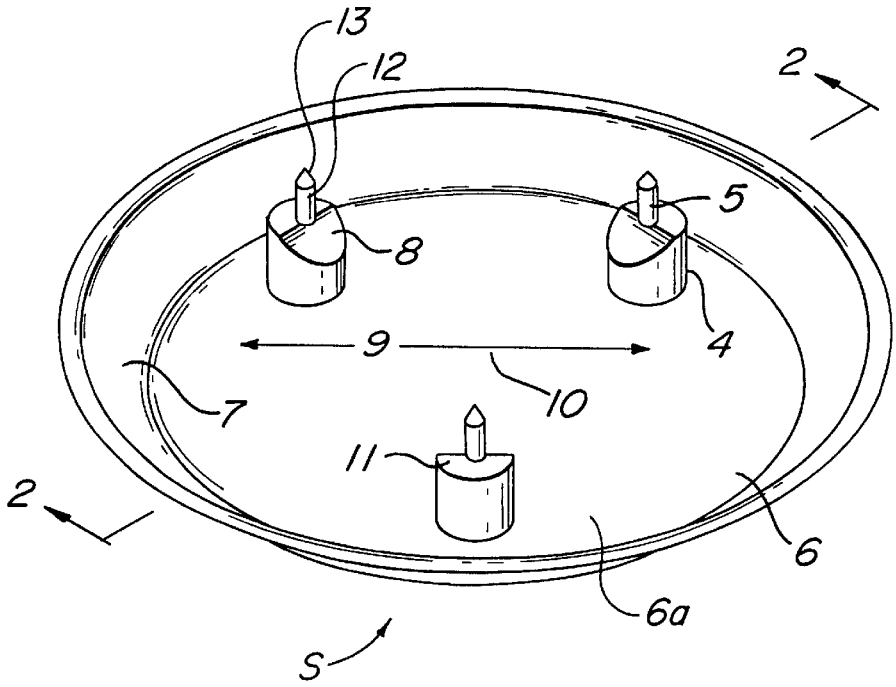
FIG. 1 is a perspective view of a first embodiment of a pumpkin stand embodying the present invention.
Figure 2:
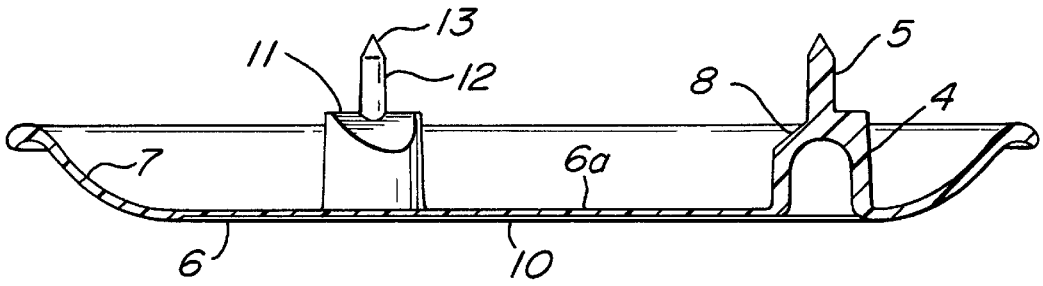
FIG. 2 is a cross-sectional view taken along line 2—2 of the pumpkin stand illustrated in FIG. 1.

Referring to FIG. 1, the stand S comprises a substantially circular dish 6. A plurality of pedestals 4 project from the top side 6*a* of the dish bottom 6 to the approximate height of the flange top. The pedestals have pins 5 for piercing and securing a pumpkin P when the pumpkin is positioned atop the pedestals 4 as illustrated in FIG. 3. In a preferred embodiment, only three pedestals are necessary, considering that the pumpkin will seat after it engages three pedestals.

The dish portion of the stand S consists of a circular flat bottom portion 6 and preferably an integral upturned peripheral flange 7. Two sizes of stands are desirable, a large for pumpkins having diameters in a range of about 10 inches to about 15 inches, and a small for pumpkins having diameters in a range of about 6 inches to about 10 inches. A large stand S has a preferred flat bottom diameter of approximately 7¾ inches with the upturned flange 7 extending around the bottom circular perimeter, forming a total dish diameter of approximately 10 inches. A small stand S has a total dish diameter of approximately 8 inches with a pedestal circle diameter of 5 inches. Preferably, small annular bosses are provided on the underside of the dish in alignment with each pedestal to limit any tendency of the dish to tip.

The pedestals 4 in the instant invention are preferably cylindrical and preferably have diameters and heights of about ¾ of an inch, thus providing seats 11 for a pumpkin approximately ¾ of an inch above the top side 6*a* of the dish bottom.

Each pedestal seat has a chamfer 8 inclined toward the center 10 of the dish bottom 6 at the preferable angle of 45° for forming a good fit with the curved lower periphery of a pumpkin.

It is also preferable that the pedestals 4 in this invention be located on a pedestal circle 9 concentric with the dish center 10, and that the seats 11 on the pedestals be at about the same height as the top of the peripheral flange 7.

The preferred diameter of the circle on which the pedestals are centered should be on the order of about one half of the diameter of the largest pumpkin expected to be supported. For example: If the largest pumpkin to be carved has a diameter of 15 inches, then a pedestal circle diameter of 7 inches would be provided for a large size stand S. If smaller pumpkins are to be supported, then a pedestal circle diameter of 5 inches would be provided for a small size stand S. These diameters ensure that pins will penetrate small pumpkins at the bottom, and not the sides, while supporting larger pumpkins without their easily tipping over. The pedestals are located on radials disposed at 120° included angles from the center 10.

The pins 5 project from the seats 11 in a range of between about ⅛ inch to about 1 inch, and preferably about one-half inch. Desirably, the pins 5 consist of an elongate cylindrical shaft portion 12 terminating in a sharp point 13. However, when integrally molded, the pins may have vertically elongate ribs (not shown) that taper outwardly in a downward direction from their tips.

The stand S in FIG. 3 is preferably constructed of a durable lightweight water impermeable material, such as plastic, including but not limited to polyethylene, polypropylene, Melmac etc. It is preferably injection molded. Preferably, the pins 5 are integrally molded with the stand. A rubber skid proof undercoating may also be provided in the event that the disclosed support bosses (not shown) are not utilized.

The pumpkin stand described is best used as in FIG. 3 by impaling a pumpkin P on the upwardly projecting pins 5 and seating it on the pedestals 4. The pumpkin P may then be carved into a jack-o-lantern, capturing the juices and pumpkin debris in the dish portion 6 of the stand S below. The dish can then be emptied, with pumpkin still in place, by tilting the pumpkin and stand horizontally to allow the juices and debris to slide out. After carving the pumpkin P, the stand S makes an attractive base for display, while protecting an underlying surface from any matter that may further drop from the supported pumpkin. In addition, the stand S enables ambient air to circulate completely about the pumpkin, particularly its bottom, preventing moisture that might otherwise accelerate degradation of the pumpkin from contacting the bottom of the pumpkin.

Figure 4:
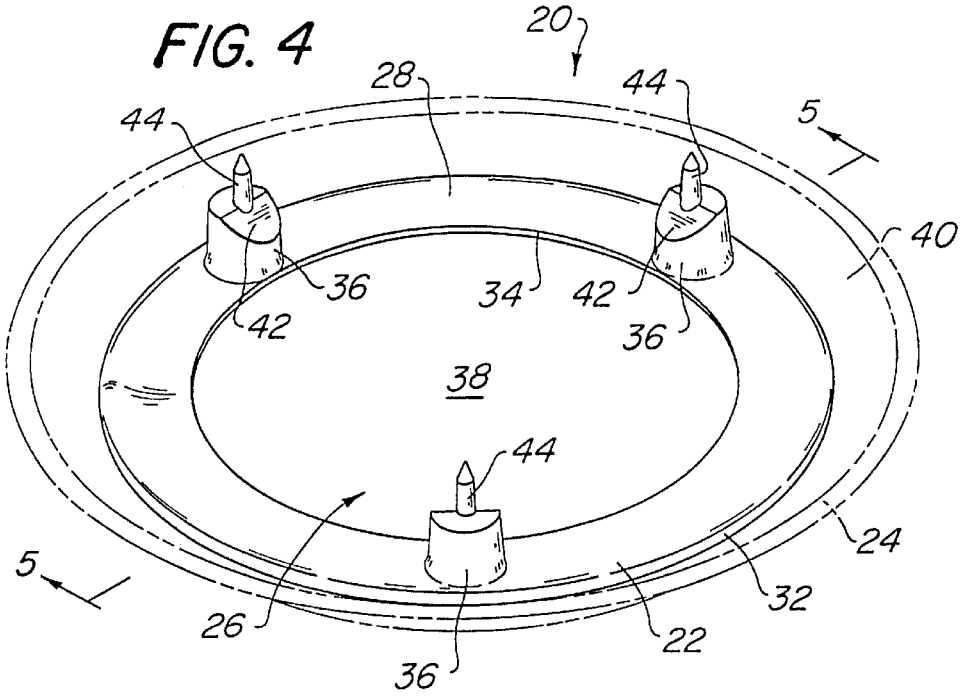
FIG. 4 is a persective view of a second embodiment of a pumpkin stand embodying the present invention which utilizes a base seated in a separate receptacle.
Figure 5:
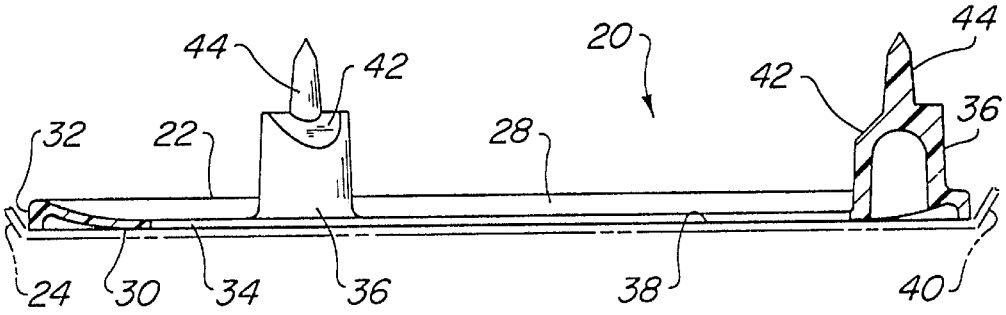
FIG. 5 is a cross sectional view taken along line 5—5 of the pumpkin stand illustrated in FIG. 4.
Figure 6:
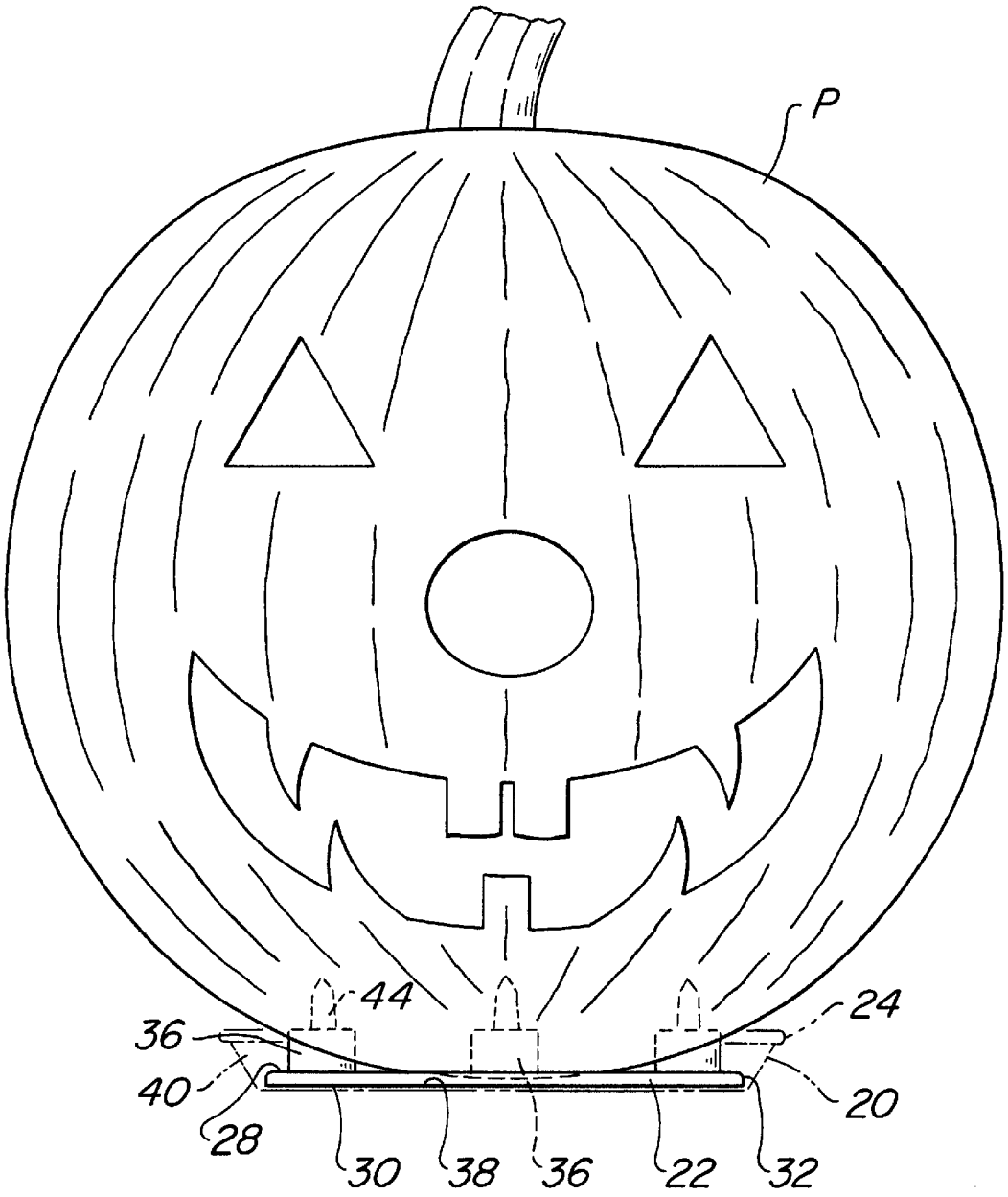
FIG. 6 is an elevational view of the stand of FIG. 4 while performing its intended function of displaying a carved pumpkin.

If desired, the upturned peripheral flange 7 may be eliminated and the dish may be made smaller in diameter for placement in a larger separate dish having an upturned peripheral flange to provide for fluid collection, without requiring a monolithic structure as in the preferred embodiment. In addition, in order to provide a low cost pumpkin stand, the amount of plastic utilized to make the stand can be reduced by providing the stand as an annular-shaped base. To this end, FIGS. 4–6 illustrate a stand 20 including an annular base 22 which seats in, and is removable from, a separate receptacle 24. The low cost base 22 can be sold separately from the receptacle 24 and can be utilized in any appropriately-sized dish, receptacle or container.

Preferably, the base 22 is annular defining a central opening 26 and having a topside 28, an underside 30, outer and inner peripheral edges 32 and 34, and a plurality of integrally-formed, hollow, upstanding pedestals 36. As best illustrated in FIG. 5, the topside 28 and underside 30 of the relatively thin ring-shaped base 22 are substantially flat so that the base 22 can be positioned on the bottom 38 of the receptacle 24 with the underside 28 of the base 22 confronting the bottom 38 of the receptacle 24. Thus, since the thin annular base 22 is positioned on the bottom 38 of the receptacle 24, the upturned peripheral flange 40 of the receptacle 24 is in a position to catch, capture and confine the juices and debris discharged from the pumpkin P during carving and/or display. In addition, preferably the outer peripheral edge 32 of the base 22 is formed slightly elevated with respect to the inner peripheral edge 34 of the base 22 so that any liquid which falls onto the topside 28 of the base 22 is funneled into the central opening 26 of the base 22 and onto the bottom 38 of the receptacle 24.

The pedestals 36 project integrally from the topside 28 of the base 22 and each provides an upraised seating surface 42 for the bottom portion of the pumpkin P. Preferably the seating surfaces 42 are chamfered and incline toward the central opening 26 to properly seat the bottom portion of the pumpkin P in a stable manner. Each pedestal 36 has an integrally formed pin 44 projecting upwardly above said seating surface 42 for piercing the bottom portion of the pumpkin P to position the pumpkin P so as to preclude movement with respect to the base 22. As illustrated in FIG. 6, the pedestals 36 elevate the pumpkin P completely above the underlying receptacle 24 and base 22 to ensure complete ventilation of the pumpkin P while on display.

While preferred embodiments have been described in detail, various modifications, alterations and changes may be made without departing from the spirit or scope of the present invention as defined in the appended claims.

What is claimed is:

1. A pumpkin stand for supporting a bottom portion of a pumpkin, comprising:

a base having a topside with an outer peripheral edge and an inner peripheral edge defining a central opening;

a plurality of pedestals projecting integrally and upwardly from said topside of said base between said outer and inner peripheral edges, each pedestal having a chamfered surface inclined toward said central opening to provide a seat for the bottom portion of the pumpkin; and each pedestal having an integrally formed pin projecting upwardly above said seat of said pedestal for piercing the bottom portion of the pumpkin to position the pumpkin so as to preclude movement with respect to said base;

whereby the pumpkin can be placed on the pedestal, carved and displayed.

2. A pumpkin stand according to claim 1, wherein said pedestals elevate the pumpkin bottom completely above an underlying surface to ensure complete ventilation of the pumpkin while on display.

3. A pumpkin stand according to claim 2, wherein said base is annular.

4. A pumpkin stand according to claim 3, wherein said outer peripheral edge of said topside of said base is slightly elevated relative to said inner peripheral edge so that any juices discharged from the pumpkin onto said annular base is substantially funneled toward said central opening.

5. A pumpkin stand according to claim 3, wherein said base is substantially planar and said pedestals are hollow.

6. A pumpkin stand according to claim 4, wherein said chamfered surfaces are disposed at an angle of about 45° relative to the horizontal.

7. A pumpkin stand according to claim 6, further comprising a separate receptacle having a bottom on which said annular base is seated, said receptacle having an upturned peripheral flange for confining any liquids discharged from the pumpkin.

8. A pumpkin stand according to claim 2, further comprising a separate receptacle having a bottom on which said base is seated, said receptacle having an upturn ed peripheral flange for confining any liquids discharged from the pumpkin.

9. A pumpkin stand for supporting a bottom portion of a pumpkin, comprising:

a dish having a bottom and an upturned peripheral flange for containing liquids;

a separate base having an underside and a topside, said underside of said base confronting and being seated on said bottom of said dish;

said base having an inner peripheral edge defining a central opening and an outer peripheral edge which is slightly elevated relative to said inner peripheral edge;

said base having at least three upraised surfaces each located on hollow pedestals projecting integrally and upwardly from said topside of said base between said outer and inner peripheral edges for supporting a pumpkin above said central opening and said dish bottom;

each pedestal having a pin projecting upwardly from said base above said upraised surface for piercing the bottom portion of the pumpkin to position the pumpkin against movement with respect to said base; and each of said upraised surfaces having a chamfered surface inclined toward said central opening to provide a seat for the bottom portion of the pumpkin;

whereby the pumpkin can be placed on said upraised surfaces and carved while any juices discharged are collected in said dish.

10. A pumpkin stand according to claim 9, wherein said base is annular.

* * * * *